United States Patent [19]

Uchiya et al.

[11] Patent Number: 4,670,318

[45] Date of Patent: Jun. 2, 1987

[54] LAMINAR BLOCK AND METHOD OF AND APPARATUS FOR PRODUCING THE LAMINAR BLOCK

[75] Inventors: Takao Uchiya, Sawara; Haruo Kawashima, Narita, both of Japan

[73] Assignee: Toshiba Monofrax Company, Ltd., Chiba, Japan

[21] Appl. No.: 829,474

[22] Filed: Feb. 13, 1986

Related U.S. Application Data

[63] Continuation of Ser. No. 609,644, May 14, 1984, abandoned.

[30] Foreign Application Priority Data

May 20, 1983 [JP] Japan ..... 58-88888

[51] Int. Cl.[4] ..... C04B 43/02

[52] U.S. Cl. ..... 428/102; 156/93; 264/30; 428/284; 428/298; 428/920

[58] Field of Search ..... 428/102, 443, 920, 93, 428/234, 224, 284, 298; 156/93; 264/30

[56] References Cited

U.S. PATENT DOCUMENTS

| | | | |
|---|---|---|---|
| 1,337,993 | 4/1920 | Bird | 428/102 |
| 2,557,668 | 6/1951 | Lincoln | 112/117 X |
| 2,652,013 | 9/1953 | Wanzer et al. | 112/3 |
| 2,788,053 | 4/1957 | Dolbey et al. | 156/93 |
| 3,405,674 | 10/1968 | Coates et al. | 156/93 |
| 3,647,606 | 3/1972 | Notaro | 156/93 |
| 3,819,468 | 6/1974 | Sauder et al. | 161/152 |
| 4,006,696 | 2/1977 | Robertson | 112/117 |
| 4,123,886 | 11/1978 | Byrd, Jr. | 52/509 |
| 4,144,612 | 3/1979 | Yamaguchi | 15/208 |
| 4,331,091 | 5/1982 | Parker et al. | 112/262.1 |

FOREIGN PATENT DOCUMENTS

| | | |
|---|---|---|
| 108019 | 9/1897 | Fed. Rep. of Germany . |
| 405902 | 10/1959 | Switzerland . |
| 462962 | 3/1937 | United Kingdom . |
| 1084694 | 9/1967 | United Kingdom . |
| 2027073 | 2/1980 | United Kingdom . |

*Primary Examiner*—John E. Kittle

*Attorney, Agent, or Firm*—Oblon, Fisher, Spivak, McClelland & Maier

[57] ABSTRACT

A laminar block for lining an inner wall of a furnace is composed of a number of individual laminated sheets of inorganic fibers sewed together by means of chain stiches. When the laminar block is cut to size, severing the thread, the chain stitches prevent the laminated sheets from separating.

27 Claims, 7 Drawing Figures

LAMINAR BLOCK AND METHOD OF AND APPARATUS FOR PRODUCING THE LAMINAR BLOCK

This application is a continuation of Ser. No. 609,644, filed on May 14, 1984, now abandoned.

BACKGROUND OF THE INVENTION

This invention concerns a laminar block having a plurality of integrally laminated sheet-like members each of which is made of inorganic fibers, a method of producing such a laminar block and a novel apparatus for producing such a laminar block.

Laminar blocks each comprising a plurality of integrally laminated sheet-like members, each of which is made of inorganic fibers are employed, for instance, as linings to the wall part of the main body of a kiln of furnace for use in ceramic industry for heat-insulating or warm-keeping purpose.

One example of conventional laminar blocks used for the lining of the furnace wall is shown in FIG. 1. A laminar block 1 in FIG. 1 comprises blankets 2,2, . . . each of which is made of inorganic fibers. In the laminar block 1 illustrated in the figure, thirteen sheets of rectangular blankets 2 are laminated. A laminer body 4 composed of the thirteen laminated rectangular blankets 2 are integrated to form the block 1 by a single thread 5, which is inserted into the laminar body 4 of the thirteen blankets 2 and bound at the both ends thereof so as to constitute a closed loop 3.

Upon using the laminar block 1 for the lining on the wall portion of the furnace main body, it is disposed and secured within the furnace main body such that a face of the laminar block 1 at which the laminated portion is exposed, or the side face 6 is in contact with the inner surface of the wall portion of the furnace main body.

In the production of the laminar block 1, the size of the block 1 or the size of the blanket 2 is often specified to a certain standard size in view of the productivity or the like. When the laminar block is used for the lining on the wall of furnaces with different sizes or shapes, the laminar block 1 is cut into an optimum shape at the working place of applying the lining corresponding to the shape and the size of the applied portion.

However, in a case where the laminar block 1 illustrated in FIG. 1 is cut, for instance, into two subblocks 8 and 9 along the plane shown by an imaginary line 7 in FIG. 1, the loop 3 of the thread 5 is cut or disconnected at two points 10 and 11 leaving each of the sub-blocks 8 and 9 in a state where the thread part 12 or 13 is merely inserted therein. Accordingly, the laminated blanket portions 2*a* and 2*b* of the laminar sub-blocks 8, 9 can no more be kept integral.

For the integral lamination of blankets made of inorganic fibers, it has also been known to apply adhesives between blankets laminated with each other and securing the blankets to each other to form a laminar block.

In the laminer block in which laminated blankets are fixed with each other by means of the adhesives, however, each blanket constituting the laminer block is likely to be separated because each blanket is made of a stack of inorganic fibers.

Moreover, in the case of using inorganic adhesives, for example, in order to provide the laminar block with a sufficient heat-resistance, there is a difficulty in cutting the laminar block due to the high rigidity of the solidified adhesive layer.

Furthermore, in the case where the inorganic adhesives are used between the blankets, there is fear that the adhesives may be firmly sintered with the fibers of the upper and lower blankets upon actual furnace operation, whereby intra-layer peeling may some time be resulted within the blanket in parallel with the plane of adhesion depending on the shrinkage of the fibers.

In addition, upon using the adhesives between the blankets to be laminated, it is actually impossible to move the laminar body until the applied adhesives between the blankets are cured, as well as the intra-layer peeling have often been caused to the blankets when external forces are applied during so-called handling work such as transportation of the laminar block even after the adhesives have been cured.

This invention has been accomplished in view of the foregoings in order to reduce at least a part of the disadvantages of the conventional laminar block and the object thereof is to provide a laminar block which can be cut relatively readily into a desired shape or size as required and in which the laminated state of the cut pieces formed by the cutting of the laminar block is likely to be maintained.

According to this invention, the above object can be attained by a laminar block comprising:

a laminar body composed of a plurality of laminated sheet-like members, each member being made of the inorganic fibers;

at least one first stitching thread parts, each having a first surface thread part extended along an outer surface of a sheet-like member situated at one surface side of the laminar body, a first penetrating thread part extended substantially continuously from one end of the first surface thread part so as to penetrate the laminar body in a direction of a thickness thereof and a second penetrating thread part extended substantially continuously from the other end of the first surface thread part so as to penetrate the laminar body in the direction of the thickness thereof; and at least one second stitching thread parts, each having a second surface thread part extended along an outer surface of a sheet-like member situated at said one or the other surface side of the laminar body, a third penetrating thread part extended substantially continuously from one end of the second surface thread part so as to penetrate the laminar body in the direction of the thickness thereof, and a fourth penetrating thread part extended substantially continuously from the other end of the second surface thread part so as to penetrate the laminar body in the direction of the thickness thereof at a portion different from that where the first and second penetrating thread parts of adjacent one first stitching thread part penetrate the laminar body.

In the block according to this invention, if the first stitching thread part is disconnected at the first surface thread part, the integrated state of the cut piece is maintained at least by the second stitching thread part.

In this specification, the laminar body is referred to as a body produced by laminating or stacking a plurality of the sheet-like members made of the inorganic sheet-like members in which laminated or stacked sheet-like members are not integrated with each other, and the laminar block is referred to as the integrated laminar body in which the laminated or stacked sheet-like members are substantially integrated to form a unit.

In an embodiment of this invention, the second surface thread part is situated, for instance, at the outer surface of the sheet-like member situated at the other surface side of the laminar body.

In a preferred embodiment of this invention, a penetrating end of the first penetrating thread part of the first stitching thread part is substantially connected with a penetrating end of the second penetrating thread part on the outer surface of the sheet-like member situated at the other surface side of the laminar body so that the integrated state of the cut pieces can be maintained more firmly or reliably. More preferably, a penetrating end of the third penetrating thread part of the second stitching thread part is substantially connected with a penetrating end of the fourth penetrating thread part on the outer surface of the sheet-like member situated at said one surface side of the laminar body.

Second penetrating thread part of one of the first stitching thread parts and the third penetrating thread part of adjacent one of the second stitching thread parts correspond to one common penetrating thread part that penetrates the laminar body substantially continuously in the direction of thickness thereof at one common portion of the laminar body, and at least one line is included in which a plurality of the first stitching thread parts and a plurality of the second stitching thread parts are arranged alternately.

In a preferred embodiment of this invention, the plurality of the first stitching thread parts and the second stitching thread parts belonging to one line are formed by a continuous thread so that an integrated laminar block can be formed with more ease by stitching.

In a preferred embodiment of this invention, a plurality of lines each of which includes the plurality of the first and the second stitching thread parts formed by the continuous thread are provided so that relatively small cut pieces produced by cutting the laminar block into various shapes may be kept integrated. Each of the plurality of lines may be composed of different threads respectively.

In one preferred embodiment of this invention, the first stitching thread part and the second stitching thread part belonging to at least one line is formed by a single chain stitch of a thread.

In an other preferred embodiment of this invention, the first and the second stitching thread parts belonging to at least one line is formed by a wave-like stitch of one thread (in this specification the "wave-like stitch" is referred to as a kind of stitch explained later in connection with FIG. 5).

In a still other preferred embodiment of this invention, the plurality of the first stitching thread parts and the second stitching thread parts belonging to at least one line comprise two continuous threads crossing to each other to be bound with each other so as to withstand the tensile force, and the first and the second stitching thread parts are formed by the lock stitch of two threads.

At least one of the first stitching thread parts may be adapted to form an independent closed loop from other stitching thread parts, and at least one of the second stitching thread parts may also be adapted to form an independent closed loop from other stitching thread parts. The closed loop may be formed by binding of adjacent thread parts, or by securing of adjacent thread parts by adhesives.

The inorganic fiber constituting the sheet-like member for use in a laminar block according to this invention comprise one or more among a crystallized fiber made of a material such as mullite and alumina, a ceramic fiber made of a material such as alumino silica, a rock wool, a glass fiber, and the like. The fiber may be composed of a plurality of fine twisted fiber. The diameter, the length and the cross sectional shape of the inorganic fiber may optionally be selected depending on the kind of the sheet-like member and application use of the laminar block.

The sheet-like member for use in the laminar block according to this invention may be a blanket, felt and/or bulk fiber assembly.

The density, the thickness, the standard shape or size for each of the sheet-like members, as well as the number of sheet-like materials constituting one laminar block may optionally be selected depending on the application use.

The sewing or stitching thread used in the laminar block according to this invention may be those threads made of natural organic materials such as linen and cotton, those threads made of synthetic organic material such as synthetic rubber, rayon, acetate and nylon, those threads made of synthetic or artificial inorganic fibers such as ceramic fibers, glass fibers and carbon fibers, as well as those threads made of metallic material such as nickel, chromium and stainless steel and a twisted strands made of ceramic fibers or glass fibers, which may be used solely or in admixture of two or more of them so long as the sewing thread can serve to maintain the laminar block or the cut portion thereof in an integrated state until the block or the cut portion thereof is set or disposed to a desired position in an apparatus or the like such as a furnace.

The number of stitches per unit length or the stitch number per inch, that is, the number of the surface thread parts of the first and/or the second stitching thread parts per unit length in each of the lines in the case where there are at least one line comprising a plurality of the first stitching thread parts and the second stitching thread parts, as well as the number of stitches per unit surface area, that is, the number of the surface thread parts of the first and/or the second stitching thread parts per unit surface area of the sheet-like member at a side of the laminar block in the case where there are at least one line comprising a plurality of the first and the second stitching thread parts can optionally be selected depending on the kind and the material of the sheetlike members to be laminated, the density and the thickness of the laminar body or the laminar block, the material and the diameter of the stitching thread, as well as the diameter of the stitching needle that can be used.

Specifically, in the case where the laminar block is properly cut into pieces, for instance, better integrity between each of the laminated sheet-like members in the produced piece or sub-block can be obtained as the number of the stitches is increased. However, if the number of the stitches is excessively increased, the strength of the laminar block may rather be reduced due to the increase of the hole area in the block left after the passing of the sewing needle, and the thread may be slackened due to the joining of adjacent stitches or short-cut of the stitching thread.

Furthermore, since the sheet-like member, e.g., a blanket made of fibers has a considerable hardness due to the nature of the constituent inorganic fibers, a considerable mechanical resistance is resulted upon insertion of a stitching needle and a thread although the blanket is fibrous. Then, the needle and the thread have to be suitably tough and rigid and in a considerable diameter in order to withstand such a mechanical resistance. Thus, it is not so advantageous to increase the number of stitches excessively.

Accordingly, the practical length for each of the stitches (corresponding to the feeding amount or length of the sewing machine), that is, the length for each of the first and/or second surface thread parts is usually in a range between 10–100 mm.

In addition, the length for the surface thread part of the first stitching thread part and that of the second stitching thread part may be equal to or different from each other, or the length of the surface thread part of the first or the second stitching thread part may be or may not be uniform.

The laminar block according to this invention, is applicable not only to the heat-insulating or warm-keeping wall such as the lining of the furnace wall but it is also applicable to other application uses such as sound insulation walls, cold insulation walls and cushions for use at a high temperature.

Another object of this invention is to provide a method of producing the laminar block according to this invention as described above.

In accordance with this invention, the foregoing another object can be attained by a method of producing a laminar block comprising a step of stitching a laminar body composed of a plurality of laminated sheet-like materials, made of inorganic fibers, to each other by at least one thread.

The stitching of the laminar body can be carried out using one thread, two threads or three or more threads. Further, the stitching may be carried out by any means usually employed for the stitching of cloths such as single chain stitch, lock stitch or the like.

In a preferred embodiment of the method according to this invention, the stitching is carried out by the single chain stitch.

The method according to this invention may also comprise a further step of securing adjacent stitching thread parts produced at the stitching step by means of binding or by adhesives so that at least one stitch formed by stitching may form independent closed loop.

A further object of this invention is to provide an apparatus for manufacturing the laminar block according to this invention as described above.

The above object of this invention can be attained in accordance with this invention by an apparatus for a single chain stitch comprising:

a sewing needle having a recess capable of engaging and disengaging a thread at a side wall portion on a top end thereof and adapted to be moved reciprocatingly along a longitudinal direction thereof; and an auxiliary needle adapted to be moved to one outer surface of a laminar body along the sewing needle in a space on one side of the laminar body composed of a plurality of laminated sheet-like members made of inorganic fibers such that a first loop-like thread portion of a sewing thread, engaged upon forward movement of the sewing needle to the recess of the sewing needle when the top end of the sewing needle inserted into the laminar body from the outer surface of a sheet-like member situated on one side thereof is protruded out of the outer surface of a sheet-like member situated on the other side of the laminar body, exposed, upon returning movement of the sewing needle, to said one side of the laminar body passing through the laminar body while being engaged in the recess, and disengaged from the recess of the sewing needle, is engaged with the auxiliary needle upon next forward movement of the sewing needle before the sewing needle is again inserted into the laminar body from said one side, and adapted to be moved apart from said one side of the laminar body in the space on said one side of the laminar body such that the engagement of the auxiliary needle with the first loop-like thread part is released when a second loop-like thread part, engaged to the recess upon the next forward movement of the sewing needle and passed through the laminar body and the first loop-like thread in the state engaged to the recess upon next returning movement of the sewing needle, is exposed to said one side of the laminar body.

This invention is to be described in more details referring to the accompanying drawings, by which the foregoing and other objects, as well as the features of this invention will be made clearer in which.

Figure 3:
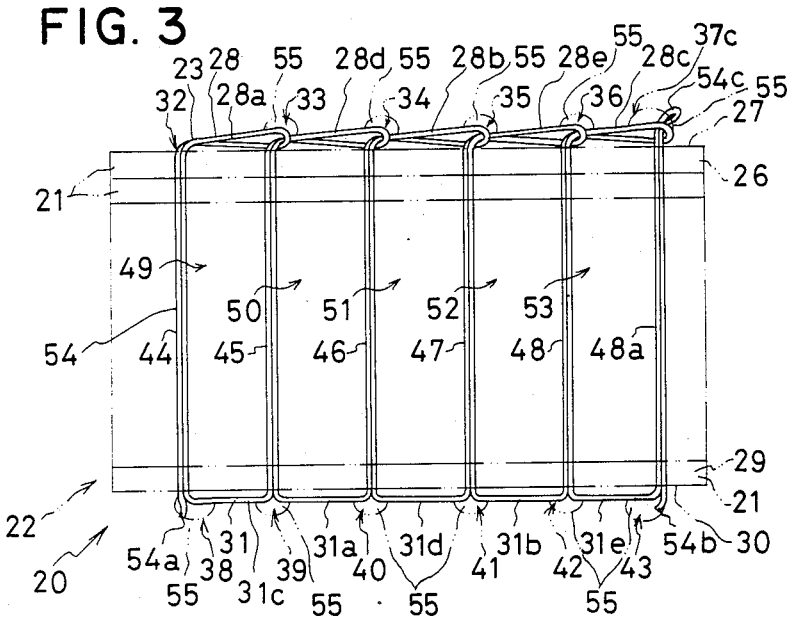
FIG. 3 is an explanatory view showing one example of the details of a thread for constituting the laminar block shown in FIG. 2.
Figure 7:
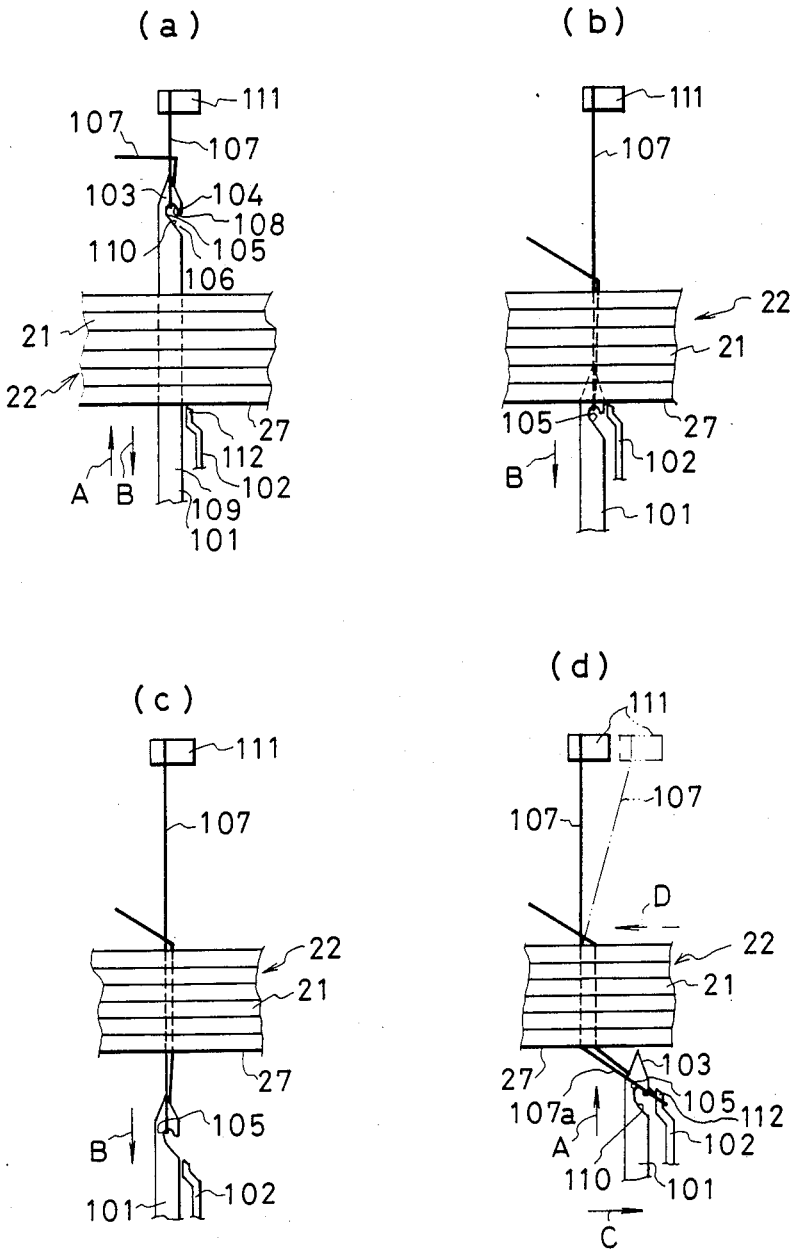
Figure 7:
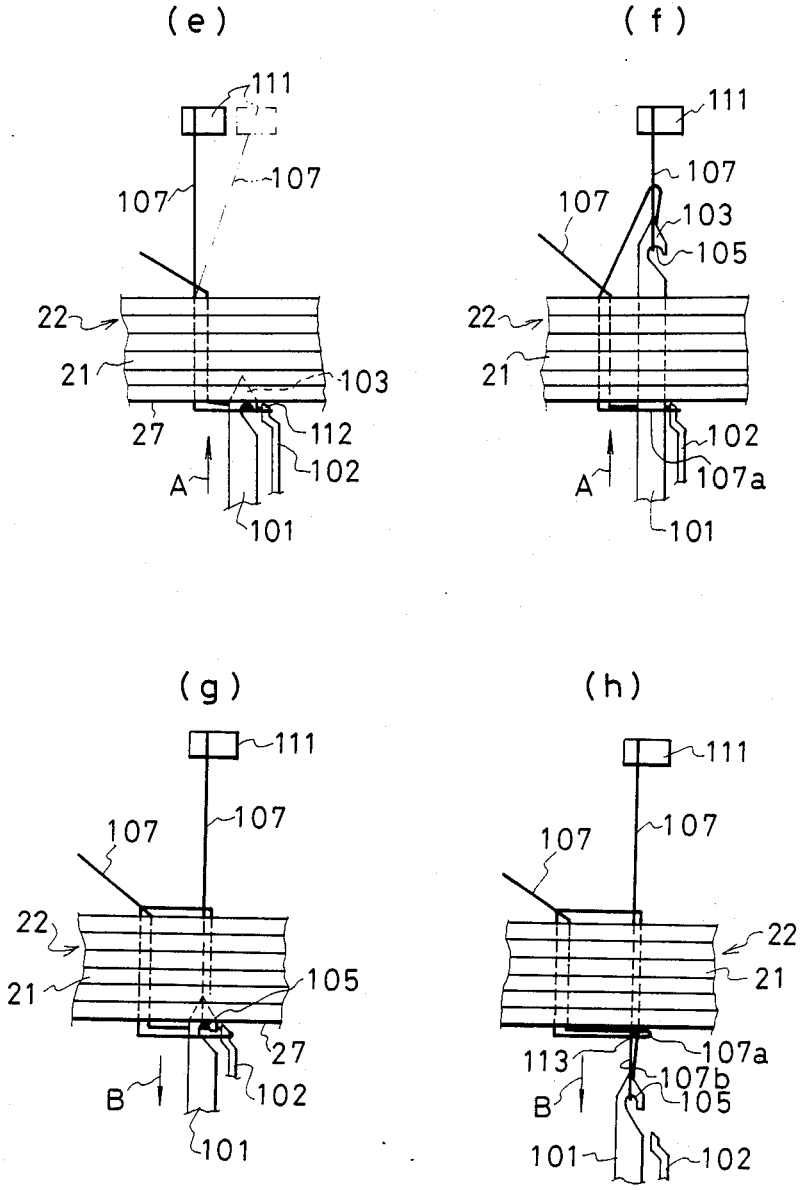

FIG. 7(*a*) through FIG. 7(*h*) are explanatory views showing the steps of a production process of the laminar block shown in FIG. 3.

Figure 2:
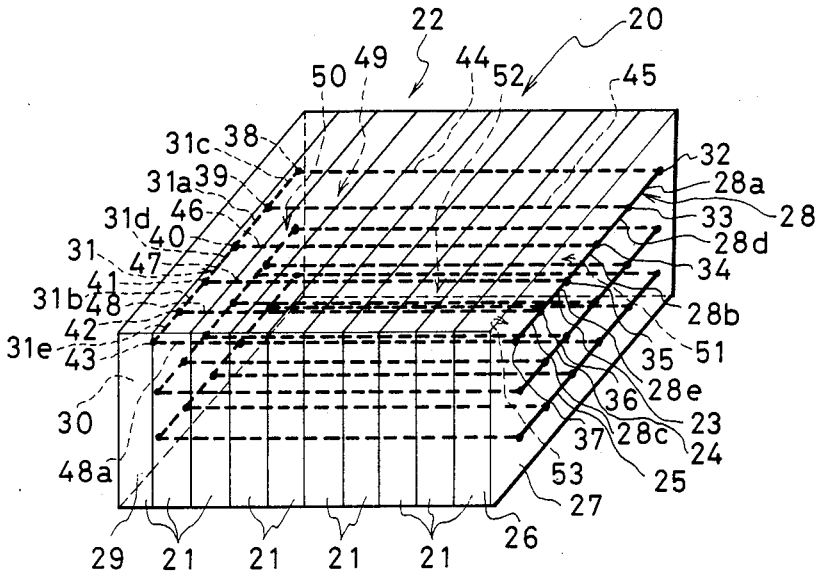
FIG. 2 is an explanatory perspective view of a laminar block as a preferred embodiment according to this invention.

In FIG. 2, a laminar block 20 as a preferred embodiment according to this invention is shown schematically.

The laminar block 20 comprises a plurality of rectangular blankets 21 as a sheet-like member, for instance, ceramic fiber blankets. A laminar body 22 consisting of ten blankets 21 laminated or stacked to each other is integrated by means of three lines of stitching or sewing threads 23, 24 and 25 made of vinylon (Kuraray Vinymo #4). In the laminar block 20, the laminar body 22 may be or may not be compressed in its thickness direction (laminating direction). The structure of the stitching thread will be described in detail only with reference to the stitching thread 23 since the structure of the stitching threads 23, 24 and 25 is identical with each other.

The stitching thread 23 comprises a front side thread part 28 extended substantially continuously along the outer surface 27 of a blanket 26 situated on one surface side of the laminar body 22, a rear side thread part 31 extended substantially continuously along the outer surface 30 of a blanket 29 situated on the other surface side of the laminar block 22, and penetrating thread parts 44, 45, 46, 47, 48 and 48*a* which are respectively connected at their one ends 32, 33, 34, 35, 36 and 37 integrally with the front side thread part 28, and at their other ends 38, 39, 40, 41, 42 and 43 integrally with the rear side thread part 31, and extended substantially continuously between both of the ends thereof so as to penetrate the inside of the laminar body 22.

Each of "the thread parts which are extended substantially continuously" may be a single thread part extended continuously or two or more thread parts extended continuously while being placed in parallel or twisted with each other. Furthermore, the thread part may comprise two or more relatively short thread parts which are firmly bound or connected to each other at their longitudinal end so as to constitute a long thread part as the whole capable of withstanding the tensile force.

The "integral connection" may be carried out by binding the thread parts, fusing the thread parts, and/or bonding these parts by means of adhesives.

The thread 23 itself may comprise one or more threads.

Figure 1:
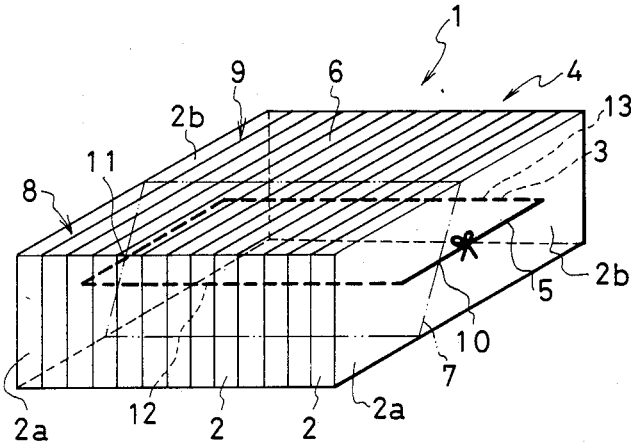
FIG. 1 PRIOR ART
FIG. 1 is an explanatory perspective view of a conventional laminar block.

In the laminar block 22, since the thread 23 forms five closed loops 49, 50, 51, 52 and 53, the laminar block 20 can be more homogenous as a whole than a type of conventional laminar block formed by the use of adhesive layers. Moreover, in a case if the block 20 is cut by means of a hand saw or the like along a line like the phantom line 7 shown in FIG. 1 to disconnect, for instance, one of the loops 50, 51, 52, each of the two cut block pieces can be retained at least by one closed loop formed by a part of the thread 23 thereby preventing the blankets of the cut block pieces from being disintegrated individually. In the explanation above, for instance, the closed loop 49 comprises a surface thread part 28*a* between the integral connection parts 32 and 33 in the front side thread part 28, two penetrating thread parts 44 and 45 and a surface thread part 31*c* between the integral connection parts 38 and 39 in the rear side thread part 31. Similarly, the closed loop 50 comprises a surface thread part 28*d* between the integral connection parts 33 and 34 in the front side thread part 28, two penetrating thread parts 45 and 46, and a surface thread part 31*a* between the integral connection parts 39 and 40 in the rear side thread part 31. The closed loops 51 and the like are formed in the similar manner.

Since the threads 24 and 25 are disposed in addition to the thread 23 in parallel therewith in the laminar block 20, if the block 20 is cut along various planes, cut block pieces or sub-blocks can be retained integrally.

The laminar body 22 may be integrated so as to form the laminar block 20, instead of using three lines of the threads 23, 24 and 25, by the use of a single line of thread, for instance, only the intermediate thread 24, by two lines of threads, for instance, the threads 23 and 25 or, furthermore, by four or more lines of threads.

Although the threads 23, 24 and 25 are extended in parallel with each other in the illustrated embodiment, one or more threads may further be extended in the direction crossing to the above-described threads 23, 24 and/or 25 so as to stitch the laminar body 22.

Referring further to the thread 23 in the laminar block 20, each of the first surface thread parts comprises, for instance, the thread part 28*a* between the integral connection parts 32 and 33 in the thread part 28, the thread part 28*b* between the integral connection parts 34 and 35 in the thread part 28 or the thread part 28*c* between the integral connection parts 36 and 37 in the thread part 28. In this case, each of the second surface thread parts comprises, for example, the thread part 31*a* between the integral connection parts 39 and 40 in the thread part 31 or the thread part 31*b* between the integral connection parts 41 and 42 in the thread part 31. In the case mentioned above, each of the first stitching thread part comprises the thread parts 28*a*, 44 and 45, the thread parts 28*b*, 46 and 47 or the thread parts 28*c*, 48 and 48*a*. Each of the second stitching thread parts comprises the thread parts 31*a*, 45 and 46 or the thread parts 31*b*, 47 and 48.

In the thread 23 of the laminar block 20, if each of the first surface thread parts comprises the thread part 28*d* between the integral connection parts 33 and 34 in the thread part 28 or the thread part 28*e* between the integral connection parts 35 and 36 in the thread part 28, each of the second surface thread parts comprises, for instance, the thread part 31*c* between the integral connection parts 38 and 39 in the thread part 31, the thread part 31*d* between the integral connection parts 40 and 41 in the thread part 31 or the thread part 31*e* between the integral connection parts 42 and 43 in the thread part 31.

Explanation will be made to the detailed structure of the thread 23 in the laminar block 20 shown in FIG. 2 referring to an example shown in FIG. 3.

In the embodiment shown in FIG. 3, the thread 23 has such an arrangement in the form of a single chain stitch of a thread 54. Specifically, the thread parts 28, 31, 44, 45, 46, 47, 48 and 48*a* comprise a continuous single strand of thread 54, in which each of the surface thread parts 28*a*, 28*d*, 28*b*, 28*e* and 28*c* in the front side thread part 28 comprises two substantially parallel thread parts of the thread 54, each of the penetrating thread parts 44, 45, 46, 47, 48 and 48*a* comprises two substantially parallel thread parts of the thread 54 and each of the surface thread parts 31*c*, 31*a*, 31*d*, 31*b* and 31*e* in the rear side thread part 31 comprises one thread part of the thread 54. Both ends 54*a*, 54*b* are left free. One end 54*a* of the thread 54 may, however, be bound to the thread part 31*c* at the integral connection part 38 and the other end 54*b* of the thread 54 may also be bound to the thread part 31*e* at the integral connection part 43. The turn back part 54*c* of the thread 54 is also left free. The part 54*c* may, however, be bound to the thread part 28*c* at one end of the final penetrating thread part 48*a* of the single chain stitch. Further, adhesives 55 are preferably applied to the integral connection parts 33, 34, 35, 36, 37, 38, 39, 40, 41, 42 and 43 excepting for the integral connection part 32 for securing adjacent or crossing thread parts in order to form a plurality of closed loops so that the integration of the laminar body 22 or each cut pieces thereof with the thread 54 or 23 may not be degraded by the disconnection of the thread 54 or 23 at least in one point.

In order to maintain the block or sub-block substantially integrally, the adjacent thread parts constituting the respective crossing parts or branching parts 32 to 43 may not be secured to each other in each of these crossing parts or branching parts 32 to 43 of the thread parts, because there is relatively little fear that the thread or penetrating thread portions may be drawn out of the laminated blankets due to the frictional forces between the blankets and the penetrating thread parts. More specifically, even if any one of the loops 49, 50, 51, 52 and 53 should be disconnected upon cutting of the block 22, other loops can still retain their configuration and prevent those blankets of the laminar block 20 constituting the cut pieces with the loops from being disintegrated individually.

In the case where a relatively large number of surface thread parts 28*a*, 28*b*, 31*a*, etc and the penetrating thread parts 44, 45, 46, etc are formed, if a certain loop should be disconnected, it may cause relatively less slacking in the thread of other loops situated at relatively remote places in a short time. Accordingly, securing of the connection parts 33, 34, 35, 36, 39, 40, 41, 42, etc with adhesives may not always be necessary.

The arrangement of the thread 23 in the laminar block 20 shown in FIG. 2 will be explained specifically referring to another embodiment shown in FIG. 4.

Figure 4:
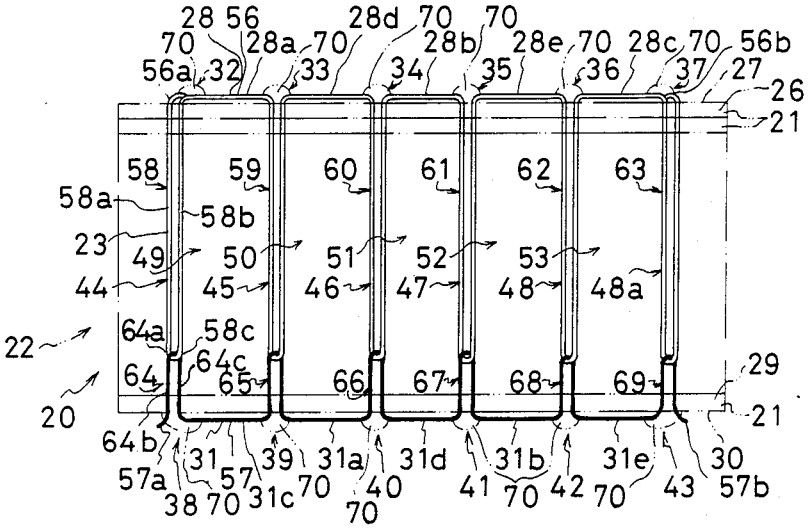
FIG. 4 is an explanatory view showing another example of the details of a thread for constituting the laminar block shown in FIG. 2.

In the embodiment shown in FIG. 4, the thread 23 has an arrangement in the form of a lock stitch of two threads 56 and 57 made, for instance, of rayon. Specifically, the upper portions 58, 59, 60, 61, 62 and 63 of the penetrating thread parts 44, 45, 46, 47, 48 and 48*a*, as well as the front side thread part 28 may be formed by a continuous single strand of thread 56, while the lower portions 64, 65, 66, 67, 68 and 69 of the penetrating thread parts 44, 45, 46, 47, 48 and 48*a*, as well as the rear side thread part 31 comprise another continuous single strand of thread 57. One or both of the threads 56 and 57 may comprise two or, more threads. Each of the surface thread parts 28*a*, 28*d*, 28*b*, 28*e* and 28*c* of the front side thread part 28 comprises one of the thread parts of the thread 56, while each of the surface thread parts 31*c*, 31*a*, 31*d*, 31*b* and 31*e* of the rear side thread part 31 comprises one of the thread parts of the thread 57. The penetrating thread part 44 comprises an upper thread portion 58 having two parallel turn back thread parts 58*a* and 58*b* of the thread 56 and a lower thread portion 64 having two parallel turn back thread parts 64*b* and 64*c* which are turned back so as to be engaged crosswise at a turn back point 64*a* to the turn back point 58*c* of the upper thread portion 58 of the thread 57. That is, the upper thread portion 58 and the lower thread portion 64 constitute the penetrating thread part 44 which is extended substantially continuously so as to withstand the tensile force as a whole. Other penetrating thread parts 45, 46, 47, 48 and 48*a* have the similar constitution as that of the penetrating thread part 44.

Adhesives 70 are applied for securing a plurality of adjacent thread parts, each having one end at each of the connection parts 32 to 43, to each other in order to constitute integral connection parts. The adhesives 70 may not be used when the size of the block is relatively large. In the illustrated embodiment, both ends 56*a* and 56*b* of the thread 56 and both ends 57*a* and 57*b* of the thread 57 are secured at each of their connection parts 32 and 37 and connection parts 38 and 43 to the adjacent thread parts by means of the adhesives 70. The adhesives 70 are not always necessary when the size of the block is relatively large.

It will also be apparent in the laminar block 20 having thus been constituted as shown in FIG. 4 that if the laminar block 20 is cut into sub-blocks, the sub-blocks can be retained integrally by the closed loops contained in each of them. In a case where a larger number of stitches, that is, a large number of penetrating thread parts are present, it is not always necessary to integrate each of the connection parts with adhesives or the likes also in this embodiment.

Figure 5:
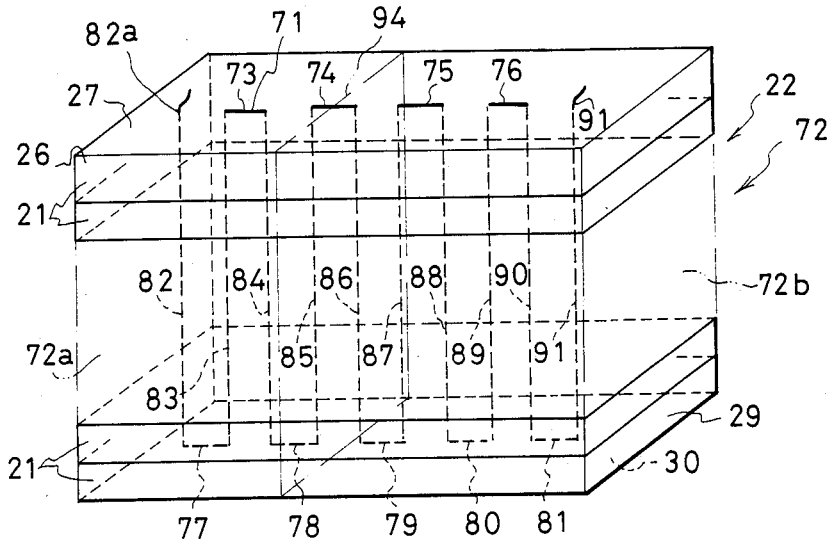
FIG. 5 is an explanatory perspective view of a laminar block as another embodiment according to this invention.

Although it is desirable for the thread parts constituting the laminar block of this invention that they form a plurality of closed loops as shown in FIGS. 2 through 4, such a plurality of closed loops may not always be necessary in a case where the number of stitches is relatively large. For instance, as shown in FIG. 5, a laminar block 72 may comprise a laminar body 22 composed or consisting of a plurality of blankets 21 laminated to each other and a thread 71 stitching the laminar body 22 in the form of a "wave-like stitch". In the laminar block 72, surface thread parts 73, 74, 75 and 76 are formed on the surface 27 of the blanket 26 situated at one surface side of the laminar body 22, while surface thread parts 77, 78, 79, 80 and 81 are formed on the surface 30 of the blanket 29 situated on the other surface side of the laminar body 22. The laminar block 72 contains ten penetrating thread parts 82, 83, 84, 85, 86, 87, 88, 89, 90 and 91 formed by the "wave-like stitch". In the laminar block 72, each of the first stitching thread parts comprises, for example, thread parts 83, 73 and 84, thread parts 85, 74 and 86, thread parts 87, 75 and 88 or thread parts 89, 76 and 90, while each of the second stitching thread parts comprises, for example, thread parts 82, 77 and 83, thread parts 84, 78 and 85, thread parts 86, 79 and 87, thread parts 88, 80 and 89 or threads parts 90, 81 and 91.

In this case, the friction between the blankets and the penetrating thread parts also serves for keeping the block integrated.

In a case if the laminar block 72 is cut along a plane shown by the imaginary line 94, the stitching thread part comprising parts 73, 78 and 85 or the stitching thread part comprising parts 87, 75 and 88, and the stitching thread part comprising parts 88, 80 and 89 can contribute to the integral retention for each cut block pieces or sub-blocks 72*a* or 72*b* within a relatively short period of time after the cutting when the sub-blocks 72*a*, 72*b* are not roughly handled as in the case of general mounting operation.

Accordingly, in the case that the laminar block 72 is cut just prior to the use of them in a working place where the cut block pieces 72*a* and 72*b* are used, closed loops are not always necessary for the cut block pieces if a relatively large number of stitching thread parts are left in each of the cut block pieces.

In a case where the block 72 is formed with the laminar body 22 being integrated in substantially a non-compression state, the closed loops may not be formed, if a relatively large number of stitching thread parts are provided.

It is of course possible, if desired, to constitute the laminar block by forming the independent closed loop respectively with each of a plurality of threads so that the laminar body can be retained as an integral block.

Figure 6:
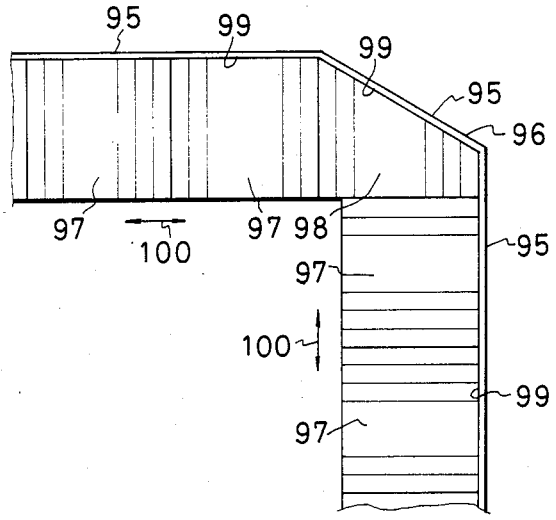
FIG. 6 is an explanatory perspective view showing an example where the laminar blocks shown in FIG. 2 are applied to the lining of a furnace wall.

FIG. 6 shows an example where the laminar blocks 20 shown in FIG. 2 and sub-block thereof produced by cutting the block 20 are applied to the lining of a furnace wall.

In FIG. 6, reference numeral 95 denotes the shell or wall portion of a furnace main body, that is, a part of the furnace wall, for instance, made of metal. Reference numeral 97 represents a laminar block of a standard size similar to the laminar block 20, and 98 represents a cut piece prepared by cutting the laminar block 20 into an appropriate size corresponding to the configuration of the wall portion 96.

The stack-lining of the blocks 97 and the block piece 98 are made by securing the blocks 97 and the sub-block 98 to the furnace wall 95 by means of adhesives or pins such that the end faces of the laminated blankets is in contact with the inner surface 99 of the furnace wall 95 and they are compressed in the laminated direction 100.

In a case where the block 97 (or 20) is cut into the sub-block 98 at a place of applying the lining work to the furnace wall by means of a hand saw or the like according to the shape of the wall portion 96 to be lined, there is little fear that the cut pieces 98 might be disintegrated individually. It is thus possible, according to this invention to apply the lining work by the use of the blocks 97 and 98 while preparing the block pieces 98 at the working place of the lining.

In the above-mentioned stack-lining, since the fibers are generally arranged in perpendicular to the lining surface, degradation of the blanket due to the exposure to a high temperature in the furnace occurs only at one end of the fibers, and the blanket can withstand higher temperature. In addition, the heat shrinkage in the laminated direction can be compensated by utilizing the restoring or expanding force of the compressed blankets. In this way, the workable or applicable temperature range of the blanket composed of inorganic fibers can significantly be extended.

Explanation will then be made to one example of a method for producing, from the laminar body 22, the laminar block 20 having a thread 23 (single chain stitch by a thread 54) constituted as shown in FIG. 3, as well as an apparatus therefor referring to FIGS. 7(*a*) through 7(*h*).

In FIG. 7, a sewing needle denoted by 101 is adapted to be displaced in the vertical direction A or B, if desired, by drive means not illustrated and an auxiliary needle denoted by 102 is also displaced in the vertical direction A or B by another drive means not shown. The needle 101 is pointed at its top end 103 and has a recess 105 with a protrusion 104 on the side of the top end 103. The intruding recess 105 capable of engaging and disengaging a thread 107 has an opening 106 on one side of the needle 101, a concave portion 108 capable of retaining a stitching thread 107 on the side of the top end 103 of the needle 101 and a slope 110 on the side of a needle base end 109 along which the stitching thread 107 is readily detached or disengaged. The needle 101 while engaging nothing in the intruding recess 105 is caused to move to the laminar body 22 composed of the blankets 21 from below in the direction A and inserted into the laminar body 22 so that the top end 103 projects out of the laminar body 22. A thread 107 is engaged, with an appropriate engaging means (not shown) if desired, to the top end 103 of the needle 101 protruded above the laminar body 22. The thread 107 can be delivered from a thread roll 111. After engaging the thread 107 on the top end 103, the needle 101 is started to move in the direction B relative to the laminar body 22 while engaging the thread 107 in the concave portion 108 of the recess 105. In this state, the top end 112 of the auxiliary needle 102 is situated substantially on or adjacent to the lower surface 27 of the laminar body (refer to FIG. 7(*a*)).

The needle 101 is further returned in the direction B while engaging the stitching thread 107 to the recess 105 as shown in FIG. 7(*b*).

In this state, the auxiliary needle 102 is still situated on the lower surface 27 of the laminar body 22. When the needle 101 leaves the surface 27 of the laminated blanket 22 to which it was inserted initially, the auxiliary needle 102 returns in the direction B to its lower end position (FIG. 7(*c*)).

When the needle 101 and the auxiliary needle 102 are lowered to the lower end position, both of them are caused to move rightwardly in the direction C relative to the laminar body 22. Instead of moving the needles 101 and 102, the laminar body 22 may be moved by a predetermined feed amount leftwardly (in the direction D) relative to the needles 100 and 102 and the roll 111. In this case, the roll 111 and the thread 107 take the positions as shown in the imaginary line in FIG. 7 (*d*). After or at the same time with the relative movement of the needles 101 and 102 in the direction C relative to the body 22 by an appropriate feed means not illustrated, the needle 101 is displaced in the direction A relative to the body 22.

When the top end 103 of the needle 101 is in abutment against the lower surface 27 of the laminar body 22, the auxiliary needle 102 which is moved upwardly in the direction A engages a loop-like thread part 107*a* of the stitching thread 107 detached from the needle 101 along the slope 110 of the recess 105 of the needle 101 at the top end 112 thereof.

The auxiliary needle 102 engaging the thread 107 at the top end 112 thereof is moved upwardly in the direction A up to its upper end position where the top end 112 is substantially in abutment against the lower surface 27 of the laminar body 22 and then stopped at that position. Then, the needle 101 is inserted at its top end 103 into the laminar body 22 and continuously moved in the direction A (refer to FIG. 7(*e*)).

The stitching thread 107 is engaged by the adequate engaging means to the recess 105 of the needle 101 which is inserted in and penetrating through the laminar body 22 of blankets 21, in the same manner as in FIG. 7(*a*) (if desired, after moving the roll 111 in the direction C relative to the laminar body 22 by a moving means not illustrated). In this state, the auxiliary needle 102 is kept in abutment against the lower surface 27 of the laminar body 22 and still engages the loop-like thread part 107*a* of the stitching thread 107 as it is (refer to FIG. 7(*f*)).

Then, when the needle 101 moved in the direction B leaves the laminar body 22 of the blankets 21 as shown in FIG. 7(*g*) or, specifically, when the recess 105 engaged with the next loop-like thread part 107*b* of the thread 107 leaves the lower surface 27 of the blanket laminar body 22 passing through the loop-like part 107*a*, the auxiliary needle 102 releases the previously engaged loop-like thread part 107*a* of the thread 107 and returns to the lowest position together with or independently from the movement of the needle 101 as shown in FIG. 7(*h*). In this case, the crossing portion 113 of the stitching thread 107 may be bound to secure by means of adhesives or the like.

The auxiliary needle 102 may be constructed in any optional manner so long as it moves vertically along the side of the needle 101 near the opening 106 of the recess 105 of the needle 101.

In this way, when the needle 101 and the auxiliary needle 102 are returned to the original lowest end position, the needles 101 and 102 are moved in the direction C relative to the blanket laminar body 22, and the needle 101 is inserted through the laminar body 22 of the blankets 21, whereby the state shown in FIG. 7(*e*) is again attained. By repeating the steps shown in FIGS. 7(*e*) to 7(*h*), continuous stitching or sewing (single chain stitch) of the laminar body 22 with the thread 107 can be carried out to produce the laminar block 20.

This invention will now be described referring to Examples.

EXAMPLE 1

A blanket 25 mm in thickness and 0.13 g/cm$^3$ in bulk density prepared from raw material composed of $Al_2O_3$ - $SiO_2$ by melting in an electric furnace, and blowing and then gathering the same and further applying a needling treatment (DURABLANKET made by Toshiba Monofrax Co., Ltd.) was cut into blanket pieces 21 each sized in 25 mm×300 mm. Sixteen sheets of such blankets were laminated to form a laminar body 22 and compressed to reduce the thickness by about 25% in the laminated direction into a size of 25 mm×300 mm×300 mm. Then, the laminar block kept in the compressed state was sewed by using a stainless steel needle 101 having 5 mm in diameter and with a pointed top end and by the steps of insertipg the needle 101 through the laminar body, engaging an industrial sewing-machine thread 107 (VINYMO #4 having 100% vinylon content manufactured by Kuraray Co., Ltd.) to the intruding recess 105 formed at about 6 mm from the top end 103, returning the needle 101 while engaging the thread 107 at the recess 105, displacing the needle 101 together with the engaged thread 107 by about 25 mm in the direction C shown in FIG. 7 where the thread 107 was detached from the intruding recess 105 of the needle 101 and engaged by an auxiliary needle 102, then inserting only the needle 101 again into the laminar body 22, engaging the thread 107 to the intruding recess 105, returning the needle 101 again and then lowering the needle 101 through the loop 107*a* of the thread 107 engaged to the auxiliary needle 102. Thereafter, the above described steps were repeated, and the laminar body was stitched at about 25 mm pitch (feeding amount). The laminar block thus stitched had 0.16 g/cm$^3$ of bulk density and retained the size of 25 mm×300 mm×300 mm which was substantially the same as the initial size. When the stitched block was bisected along the diagonal direction with a sharp knife, none of the cut pieces or sub-blocks showed change in the bulk density and none of the cut pieces was disintegrated individually.

EXAMPLE 2

A laminar body 22 was formed by laminating sixteen sheets of the same blankets as used in Example 1 each sized 25 mm in thickness, 150 mm in width and 600 mm in length. The laminar body 22 was sewed or stitched in the same manner as in Example 1 and each of the stitches was secured using instantaneous adhesives at the parts 33, 34, etc. shown in FIG. 3 to form individual loops. In Example 2, two stitch lines (for instance, two lines 23 and 25 in FIG. 3) were formed, with a distance between the two lines being 75 mm, and a large laminar block of 300 mm×150 mm×600 mm (compressed to reduce the thickness by about 25% in the laminated direction) was thus prepared. The block was bisected each in longitudinal and lateral directions (in the direction of 150 mm size and 600 mm size) by using a sharp knife into four cut pieces or sub-blocks each of 75 mm×300 mm×300 mm in size. In the similar manner to Example 1, each of the sub-blocks kept the bulk density of about 0.16 g/cm$^3$ and each of the sub-blocks was well kept in gathered condition with no individual disintegration.

What is claimed is:

1. A heat-insulating laminar block for lining an inner wall of a furnace, said laminar block comprising:

(a) a laminar body composed of a plurality of laminated sheet-like members, each one of said plurality of laminated sheet-like members being made of inorganic fibers, said laminar block being applied to the inner wall of the furnace such that planes of the sheet-like members are generally perpendicular to the inner wall of the furnace, and (b) an integrating means for integrating said plurality of laminated sheet-like members with each other in compressed states in a laminated direction thereof to form the laminar block without the use of an adhesive layer between adjacent sheet-like members, said integrating means comprising a single line of stitches extending along a longitudinal direction of the sheet-like members at a central portion in a width direction of the sheet-like members, the single line of stitches comprising a multiplicity of individual stitches made by at least one thread, each one of said multiplicity of individual stitches comprising:

(i) a first surface thread part extending along the outer surface of a first sheet-like member of said plurality of laminated sheet-like members which is situated at one surface side of said laminar body, said first surface thread part having a first end and a second end;

(ii) a first penetrating thread part extending substantially continuously from said second end of said first surface thread part through said laminar body in the direction of the thickness thereof from said outer surface of said first one of said plurality of sheet-like members to the outer surface of a second one of said plurality of sheet-like members which is situated at the opposite surface side of said laminar body, said first penetrating thread part having a first end connected to said second end of said first surface thread part and a second end;

(iii) a second surface thread part extending substantially continuously from said second end of said first penetrating thread part along said outer surface of said second one of said plurality of laminated sheet-like members, said second surface thread part having a first end connected to said second end of said first penetrating thread part and a second end; and (iv) a second penetrating thread part extending substantially continuously from said second end of said second surface thread part through said laminar body in the direction of the thickness thereof from said outer surface of said second one of said plurality of sheet-like members to said outer surface of said first one of said plurality of sheet-like members, said second penetrating thread part having a first end connected to said second end of said second surface thread part and a second end;

(v) said second end of said second penetrating thread part of each one of said multiplicity of individual stitches being connected to a first surface thread part of an adjacent one of said multiplicity of individual stitches, whereby, even when the laminar block is cut into sub-blocks across the single line of stitches, said integrating means enables the adjacent laminated sheet-like members of each of said sub-blocks to remain integrated with each other in the compressed states.

2. The laminar block of claim 1 wherein:

(a) said second end of said second penetrating thread part of each one of said multiplicity of individual stitches is connected to said first end of said first penetrating thread part of the same one of said multiplicity of individual stitches on said outer surface of said first one of said plurality of sheet-like members and (b) said second end of said first penetrating thread part of the same one of said multiplicity of individual stitches is connected to a first end of the second penetrating thread part of an adjacent one of said multiplicity of individual stitches on said outer surface of second one of said plurality of sheet like members.

3. The laminar block of claim 2 wherein:

(a) each one of said first surface thread parts is adapted to form a closed loop independently of the other one of said first surface thread parts in cooperation with adjacent second and first penetrating thread parts and with a first connecting thread part between the adjacent second and first penetrating thread parts and (b) each one of the second surface thread parts is adapted to form a closed loop independently of the other one of said second surface thread parts in cooperation with the adjacent first and second penetrating thread parts with a second connecting thread part between the adjacent first and second penetrating thread parts.

4. The laminar block of claim 3 wherein each of said closed loops is formed by binding a pair of adjacent thread parts or by securing a pair of adjacent thread parts by means of adhesive.

5. The laminar block of any one of claims 1 to 4 wherein the single line of stitches is formed from one continuous thread.

6. The laminar block of any one of claims 1 to 4 wherein the single line of stitches is formed from two continuous threads crossing each other and bound to each other so as to withstand tensile force.

7. The laminar block of claim 1 wherein the single line of stitches comprises a single chain stitch formed from one thread.

8. The laminar block of claim 1 wherein the single line of stitches comprises a lock stitch formed from two threads.

9. The laminar block of claim 7 or 8 wherein adjacent thread parts are secured by means of binding or adhesive so that one of the multiplicity of said first and second surface thread parts forms, in cooperation with the adjacent first and second penetrating thread parts, closed loops independently of the other one of the multiplicity of said first or second surface thread parts.

10. The laminar block of claim 1 wherein the thread is made of a natural material, a synthetic organic material, an inorganic material, or a metallic material.

11. A method of producing a heat-insulating laminar block of a plurality of sheet-like members for lining an inner wall of a furnace such that planes of the sheet-like members are generally perpendicular to the inner wall of the furnace without the use of an adhesive layer between adjacent sheet-like members, said method comprising the step of sewing a laminar body composed of the plurality of laminated sheet-like members made of inorganic fibers to each other so as to integrate said plurality of laminated sheet-like members with each other in compressed states in a laminated direction thereof to form the laminar block by means of a single line of stitches extending along a longitudinal direction of the sheet-like members at a central portion in a width direction of the sheet-like members, the single line of stitches comprising a multiplicity of individual stitches made by at least one thread, each one of said multiplicity of individual stitches comprising:

(a) a first furface thread part extending along the outer surface of a first sheet-like member of said plurality of laminated sheet-like members which is situated at one surface side of said laminar body, said first surface thread part having a first end and a second end;

(b) a first penetrating thread part extending substantially continuously from said second end of said first surface thread part through said laminar body in the direction of the thickness thereof from said outer surface of said first one of said plurality of sheet-like members to the outer surface of a second one of said plurality of sheet-like members which is situated at the opposite surface side of said laminar body, said first penetrating thread part having a first end connected to said second end of said first surface thread part and a second end;

(c) a second surface thread part extending substantially continuously from said second end of said first penetrating thread part along said outer surface of said second one of said plurality of laminated sheet-like members, said second surface thread part having a first end connected to said second end of said first penetrating thread part and a second end; and (d) a second penetrating thread part extending substantially continuously from said second end of said second surface thread part through said laminar body in the direction of the thickness thereof from said outer surface of said second one of said plurality of sheet-like members to said outer surface of said first one of said plurality of sheet-like members, said second penetrating thread part having a first end connected to said second end of said second surface thread part and a second end;

(e) said second end of said second penetrating thread part of each one of said multiplicity of individual stitches being connected to a first end of a first surface thread part of an adjacent one of said multiplicity of individual stitches, whereby, even when the laminar block is cut into sub-blocks across the single line of stitches, the single line of stitches enables the adjacent laminated sheet-like members of each of said sub-blocks to remain integrated with each other in the compressed states.

12. The method of claim 11 wherein the sewing is carried out in the form of a single chain stitch.

13. The method of claim 11 or 12 wherein the method comprises the further step of securing adjacent thread parts produced in the sewing by binding or by adhesives so that at least one of each pair of surface thread parts and its adjacent first and second penetrating thread parts cooperatively constitute an independent closed loop.

14. A heat-insulating laminar block for lining an inner wall of a furnace, said laminar block comprising:

(a) a laminar body composed of a plurality of laminated sheet-like members, each one of said plurality of laminated sheet-like members being made of inorganic fibers, said laminar block being applied to the inner wall of the furnace such that planes of the sheet-like members are generally perpendicular to the inner wall of the furnace, and (b) an integrating means for integrating said plurality of laminated sheet-like members with each other in compressed states in a laminated direction thereof to form the laminar block without the use of an adhesive layer between adjacent sheet-like members, said integrating means comprising a plurality of lines of stitches distributed over the planes of the sheet-like members, each line of said plurality of lines of stitches comprising a multiplicity of individual stitches made by at least one thread, each one of said multiplicity of individual stitches comprising:

(i) a first surface thread part extending along the outer surface of a first sheet-like member of said plurality of laminated sheet-like members which is situated at one surface side of said laminar body, said first surface thread part having a first end and a second end;

(ii) a first penetrating thread part extending substantially continuously from said second end of said first surface thread part through said laminar body in the direction of the thickness thereof from said outer surface of said first one of said plurality of sheet-like members to the outer surface of a second one of said plurality of sheet-like members which is situated at the opposite surface side of said laminar body, said first penetrating thread part having a first end connected to said second end of said first surface thread part and a second end;

(iii) a second surface thread part extending substantially continuously from said second end of said first penetrating thread part along said outer surface of said second one of said plurality of laminated sheet-like members, said second surface thread part having a first end connected to said second end of said first penetrating thread part and a second end; and (iv) a second penetrating thread part extending substantially continuously from said second end of said second surface thread part through said laminar body in the direction of the thickness thereof from said outer surface of said second one of said plurality of sheet-like members to said outer surface of said first one of said plurality of sheet-like members, said second penetrating thread part having a first end connected to said second end of said second surface thread part and a second end;

(v) said second end of said second penetrating thread part of each one of said multiplicity of individual stitches being connected to a first end of a first surface thread part of an adjacent one of said multiplicity of individual stitches, whereby, even when the laminar block is cut into sub-blocks, said integrating means enables the adjacent laminated sheet-like members of each of said sub-blocks to remain integrated with each other in the compressed states.

15. The laminar block of claim 14 wherein:

(a) said second end of said second penetrating thread part of each one of said multiplicity of individual stitches is connected to said first end of said first penetrating thread part of the same one of said multiplicity of individual stitches on said outer surface of said first one of said plurality of sheet-like members and (b) said second end of said first penetrating thread part of the same one of said multiplicity of individual stitches is connected to a first end of the second penetrating thread part of an adjacent one of said multiplicity of individual stitches on said outer surface of said second one of said plurality of sheet-like members.

16. The laminar block of claim 15 wherein:

(a) each one of said first surface thread parts is adapted to form a closed loop independently of the other one of said first surface thread parts in cooperation with adjacent second and first penetrating thread parts and with a first connecting thread part between the adjacent second and first penetrating thread parts and (b) each one of the second surface thread parts is adapted to form a closed loop independently of the other one of said second surface thread parts in cooperation with the adjacent first and second penetrating thread parts with a second connecting thread part between the adjacent first and second penetrating thread parts.

17. The laminar block of claim 16 wherein each of said closed loops is formed by binding a pair of adjacent thread parts or by securing a pair of adjacent thread parts by means of adhesive.

18. The laminar block of any one of claims 14 to wherein said plurality of lines of stitches is formed from one continuous thread.

19. The laminar block of any one of claims 14 to 17 wherein said plurality of lines of stitches is formed from two continuous threads crossing each other and bound to each other so as to withstand tensile force.

20. The laminar block of claim 14 wherein said plurality of lines of stitches comprises a single chain stitch formed from one thread.

21. The laminar block of claim 14 wherein said plurality of lines of stitches comprises a lock stitch formed from two threads.

22. The laminar block of claim 20 or 21 wherein adjacent thread parts are secured by means of binding or adhesive so that one of the multiplicity of said first and second surface thread parts forms, in cooperation with the adjacent first and second penetrating thread parts, closed loops independently of the other one of the multiplicity of said first or second surface thread parts.

23. The laminar block of claim 14 wherein each thread is made of a natural or synthetic organic material.

24. A method of producing a heat-insulating laminar block of a plurality of sheet-like members for lining an inner wall of a furnace such that planes of the sheet-like members are generally perpendicular to the inner wall of the furnace without the use of an adhesive layer between adjacent sheet-like members, said method comprising the step of sewing a laminar body composed of the plurality of laminated sheet-like members made of inorganic fibers to each other so as to integrate said plurality of laminated sheet-like members with each other in compressed states in a laminated direction thereof to form the laminar block by means of a plurality of lines of stitches distributed over the planes of the sheet-like members, each line of said plurality of lines of stitches comprising a multiplicity of individual stitches made by at least one thread, each one of said multiplicity of individual stitches comprising:

(a) a first surface thread part extending along the outer surface of a first sheet-like member of said plurality of laminated sheet-like members which is situated at one surface side of said laminar body, said first surface thread part having a first end and a second end;

(b) a first penetrating thread part extending substantially continuously from said second end of said first surface thread part through said laminar body in the direction of the thickness thereof from said outer surface of said first one of said plurality of sheet-like members to the outer surface of a second one of said plurality of sheet-like members which is situated at the opposite surface side of said laminar body, said first penetrating thread part having a first end connected to said second end of said first surface thread part and a second end;

(c) a second surface thread part extending substantially continuously from said second end of said first penetrating thread part along said outer surface of said second one of said plurality of laminated sheet-like members, said second surface thread part having a first end connected to said second end of said first penetrating thread part and a second end; and (d) a second penetrating thread part extending substantially continuously from said second end of said second surface thread part through said laminar body in the direction of the thickness thereof from said outer surface of said second one of said plurality of sheet-like members to said outer surface of said first one said plurality of sheet-like members, said second penetrating thread part having a first end connected to said second end of said second surface thread part and a second end;

(e) said second end of said second penetrating thread part of each one of said multiplicity of individual stitches being connected to a first end of a first surface thread part of an adjacent one of said multiplicity of individual stitches, whereby, even when the laminar block is cut into sub-blocks, said plurality of lines of stitches enables the adjacent laminated sheet-like members of each of said sub-blocks to remain integrated with each other in the compressed states.

25. The method of claim 24 wherein the sewing is carried out in the form of a single chain stitch.

26. The method of claim 25 wherein the method comprises the further step of securing adjacent thread parts produced in the sewing by binding or by adhesives so that at least one each pair of surface thread parts and its adjacent first and second penetrating thread parts cooperatively constitute an independent closed loop.

27. The method of claim 24 wherein the method comprises the further step of securing adjacent thread parts produced in the sewing by binding or by adhesives so that at least one each pair of surface thread parts and its adjacent first and second penetrating thread parts cooperatively constitute an independent closed loop.

* * * * *

UNITED STATES PATENT AND TRADEMARK OFFICE

CERTIFICATE OF CORRECTION

PATENT NO. : 4,670,318

DATED : JUNE 2, 1987

INVENTOR(S) : TAKAO UCHIYA ET AL.

It is certified that error appears in the above-identified patent and that said Letters Patent is hereby corrected as shown below:

In Column 1, line 26, change "laminer" to --laminar--;

In Column 1, line 59, change "laminer" to --laminar--;

In Column 1, line 61, change "laminer" to --laminar--;

In Column 3, line 67, change "fiber" to --fibers--;

In Column 4, line 26, delete "a";

In Column 8, line 68, change "etc" to --etc.--;

In Column 9, line 1, change "etc" to --etc.--;

In Column 9, line 6, change "etc" to --etc.--;

In Column 10, line 17, change "threads parts" to --thread parts--;

UNITED STATES PATENT AND TRADEMARK OFFICE

CERTIFICATE OF CORRECTION

PATENT NO. : 4,670,318

DATED : JUNE 2, 1987

INVENTOR(S) : TAKAO UCHIYA ET AL.

It is certified that error appears in the above-identified patent and that said Letters Patent is hereby corrected as shown below:

In Column 10, line 36, change "parts are" to --parts is--;

In Column 10, line 41, change "parts are" to --parts is--;

In Column 12, line 25, change "penetrating" to --penetrates--;

In Column 15, line 8, change "sheet like" to --sheet-like--;

In Column 20, line 19, delete "each";

In Column 20, line 25, delete "each";

In Column 18, Lines 24-25, change "claims 14 to wherein" to --claims 14 to 17 wherein--;

UNITED STATES PATENT AND TRADEMARK OFFICE

CERTIFICATE OF CORRECTION

PATENT NO. : 4,670,318

DATED : JUNE 2, 1987

INVENTOR(S) : TAKAO UCHIYA ET AL.

It is certified that error appears in the above-identified patent and that said Letters Patent is hereby corrected as shown below:

In Column 1, line 47, change "subblocks" to --sub-blocks--;

In Column 4, line 3, change "silica," to --silicate,--;

In Column 4, line 5, change "fiber." to --fibers.--;

In Column 4, line 48, change "sheetlike" to --sheet-like--;

In Column 13, line 10, change "insertipg" to --inserting--;

In Column 15, line 8, change "of second" to --of said second--;

In Column 16, line 3, change "furface" to --surface--;

Signed and Sealed this

Twenty-second Day of March, 1988

*Attest:*

*Attesting Officer*

DONALD J. QUIGG

*Commissioner of Patents and Trademarks*